US007445503B1

(12) United States Patent
Zhang

(10) Patent No.: US 7,445,503 B1
(45) Date of Patent: Nov. 4, 2008

(54) ELECTRICAL CONNECTOR WITH SHELL

(75) Inventor: George(Huanyi) Zhang, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/900,611

(22) Filed: Sep. 12, 2007

(51) Int. Cl.
*H01R 13/648* (2006.01)

(52) U.S. Cl. ..... 439/607

(58) Field of Classification Search ..... 439/607
See application file for complete search history.

(56) References Cited

U.S. PATENT DOCUMENTS

| | | | | |
|---|---|---|---|---|
| 7,175,444 | B2 * | 2/2007 | Lang et al. | 439/76.1 |
| 7,226,314 | B2 * | 6/2007 | Lang et al. | 439/607 |
| 7,303,438 | B2 * | 12/2007 | Dawiedczyk et al. | 439/607 |
| 7,331,822 | B2 * | 2/2008 | Chen | 439/607 |
| 7,344,409 | B2 * | 3/2008 | Lang et al. | 439/607 |
| 7,351,104 | B2 * | 4/2008 | Neer et al. | 439/607 |
| 2006/0009080 | A1 * | 1/2006 | Regnier et al. | 439/637 |
| 2006/0014438 | A1 * | 1/2006 | Regnier | 439/637 |
| 2006/0019525 | A1 * | 1/2006 | Lloyd et al. | 439/352 |
| 2006/0040556 | A1 * | 2/2006 | Neer et al. | 439/607 |
| 2006/0134985 | A1 * | 6/2006 | Reed et al. | 439/607 |
| 2006/0134993 | A1 * | 6/2006 | Dawiedczyk et al. | 439/676 |
| 2006/0160399 | A1 * | 7/2006 | Dawiedczyk et al. | 439/374 |
| 2006/0160429 | A1 * | 7/2006 | Dawiedczyk et al. | 439/676 |
| 2006/0189180 | A1 * | 8/2006 | Lang et al. | 439/76.1 |
| 2006/0189199 | A1 * | 8/2006 | Lang et al. | 439/374 |
| 2006/0189211 | A1 * | 8/2006 | Lang et al. | 439/607 |
| 2007/0173118 | A1 * | 7/2007 | Chen | 439/607 |
| 2008/0020640 | A1 * | 1/2008 | Zhang | 439/607 |

* cited by examiner

*Primary Examiner*—Ross N Gushi
(74) *Attorney, Agent, or Firm*—Wei Te Chung

(57) ABSTRACT

An electrical connector (100) includes an insulated housing (1), a number of terminals (2) received in the insulated housing (1), a metal shell (3) assembled to the insulated housing (1). The metal shell (3) includes an inverted U-shaped body portion (30), with a pair of arms (33) extending rearward from rear edges of transversal walls (32) and a spring member (34) slantways extending downward and rearward from rear edge of an upper wall (31) thereof. The insulated housing (1) further has a pair of enforcing beams (16) attached to the lower sections thereof and extending beyond a front face of the insulated housing (1). The insulated housing (1) is assembled between the arms (33) of the metal shell (3), with the body portion (30) located forwardly of the insulated housing (1) and the spring member (34) located above of the insulated housing (1). Each of the pair of enforcing beams (16) defines a passage (163) along a mating direction sandwiching lower sections of the corresponding arm (33) and the transversal wall (32) of the metal shell (3).

20 Claims, 7 Drawing Sheets

ELECTRICAL CONNECTOR WITH SHELL

CROSS-REFERENCE TO RELATED APPLICATION

This application is related to U.S. patent application Ser. No. 11/492,148 filed on Jul. 24, 2006 and entitled "ELECTRICAL CONNECTOR WITH SHELL", and it has the same applicant and assignee as the present invention. The disclosure of the related application is incorporated herein by reference.

BACKGROUND OF THE INVENTION

1. Field of the Invention

The present invention generally relates to an electrical connector, and more particularly to an electrical connector with a metal shell.

2. Description of Related Art

The SFF Committee is an ad hoc group formed to address storage industry needs in a prompt manner. One kind of connector named Mini SAS connector adapted for high-speed transmission has been defined by the SFF Committee. Several types of utility Mini SAS connectors have been launched and U.S. Pub. No. 2006/0160399 A1 discloses such kind of connector. The connector includes a connector guide made of sheet metal and located in front of an insulated housing. The connector guide and the insulated housing are separately mounted on a printed circuit board. When an opposing connector mates with the connector, the connector guide serves to align contact surfaces and provide strain relief to the connector. However, the insulated housing and the connector guide are handled relay on a pick-up cover/device. It is loosely control relative dimension/position therebetween. Further more, for some unexpected reasons, such as collision, pressing, etc, configuration of the connector guide may deform before it finally mounted to the printed circuit board, thus the connector guide can't accurately guiding the opposing connector mating with the connector. The aforementioned pending patent application (application Ser. No. 11/492,148) discloses an insulted housing and a metal shell (connector guide) combined together to form one piece type of electrical connector. A special design of this kind of electrical connector may decrease/eliminate aforesaid problems. Nevertheless as the metal shell is assembled to the insulated housing via a pair of relative thin and flexible arms, and relative position between the insulated housing and the metal shell may be changed for the unexpected reasons.

Hence, an improved electrical connector with a metal shell is highly desired to overcome the disadvantages of the related art.

SUMMARY OF THE INVENTION

Accordingly, an object of the present invention is to provide an electrical connector with improved structure to enhance a combination between an insulated housing and a metal shell.

In order to achieve the object set forth, an electrical connector in accordance with the present invention comprises an insulated housing, a plurality of terminals received in the insulated housing, a metal shell combined with the insulated housing. The insulated housing has a primary body portion including a top wall, a bottom wall and a pair of side walls interconnecting with the top wall and the bottom wall to cooperatively form a hollow portion. The metal shell includes an upper wall and a pair of transversal walls extending downwardly from two opposite side edges of the upper wall to form a substantially inverted U-shaped body portion. The metal shell further has a pair of arms extending rearward from rear edges of the transversal walls respectively and a spring member slantways extending downward and rearward from rear edge of the upper wall. The insulated housing further has a pair of enforcing beams attached to the lower sections thereof and extending beyond a front face of the insulated housing. The insulated housing is assembled between the arms of the metal shell, with the body portion of the metal shell located forwardly of the insulated housing and the spring member of the metal shell located above of the insulated housing. Each of the pair of enforcing beams defines a passage along a mating direction sandwiching lower sections of the corresponding arm and the transversal wall of the metal shell.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
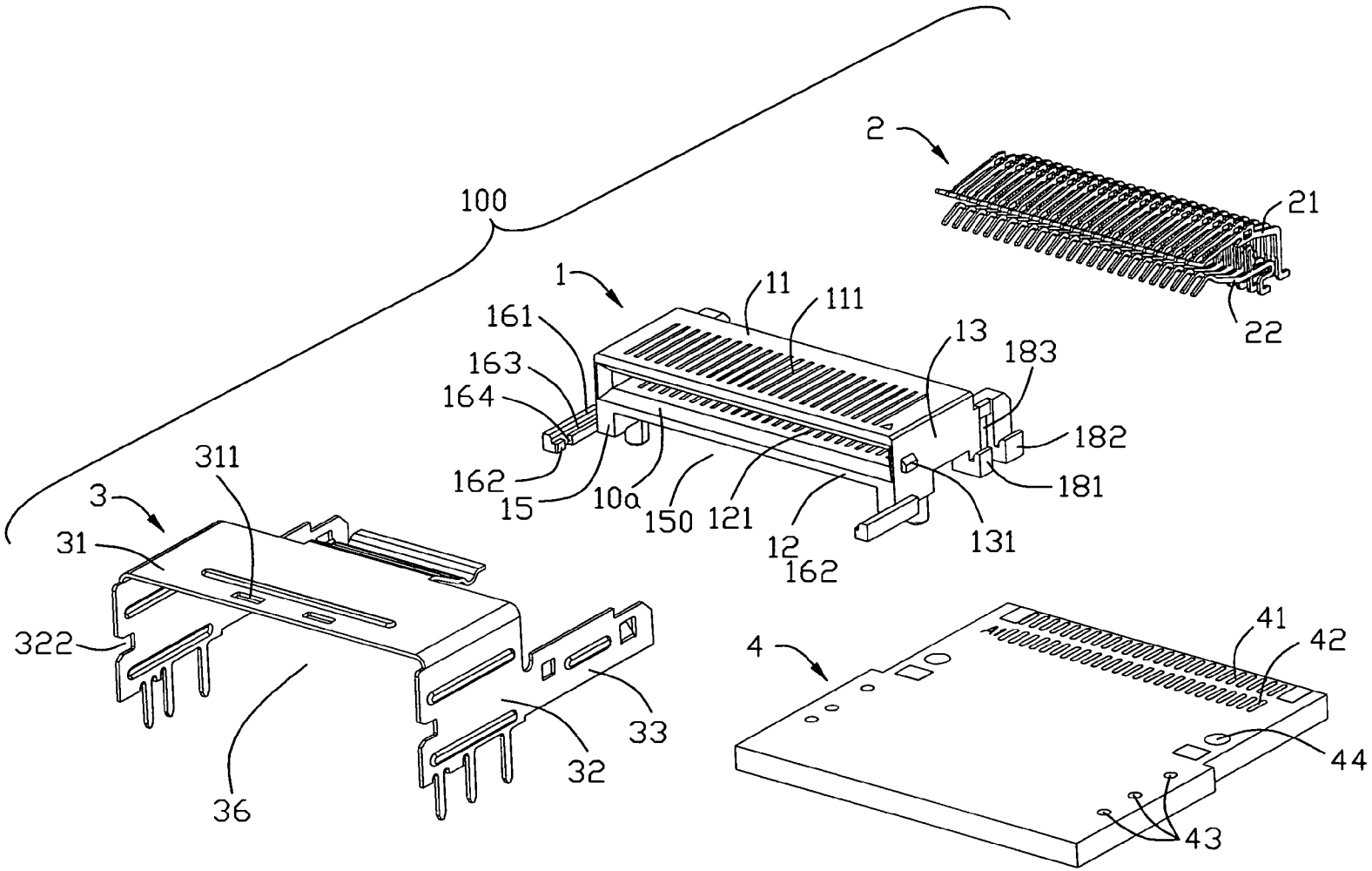
FIG. 1 is an exploded, perspective view of an electrical connector in accordance with the present invention.
Figure 2:
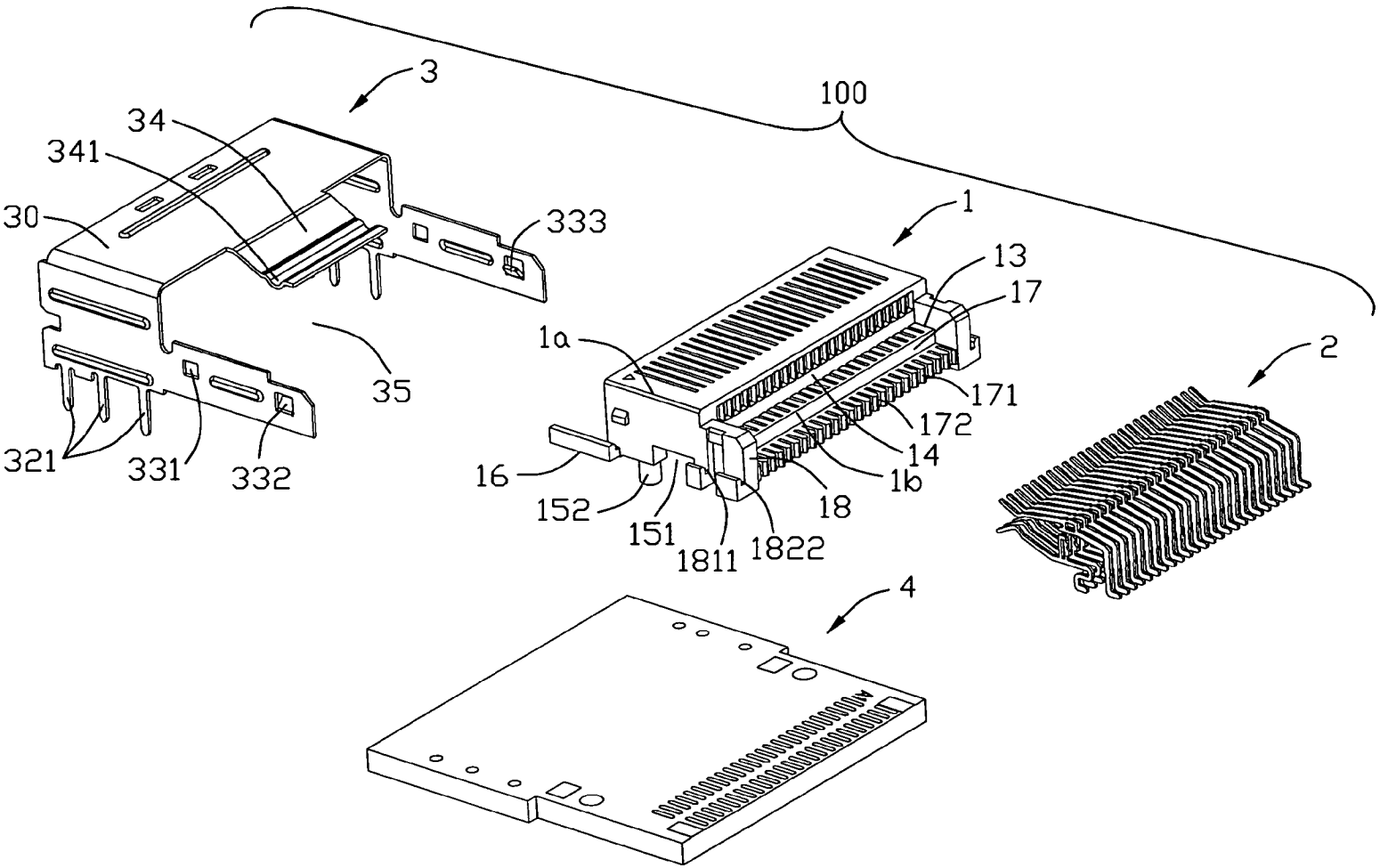
FIG. 2 is a view similar to FIG. 1, but viewed from another aspect.
Figure 3:
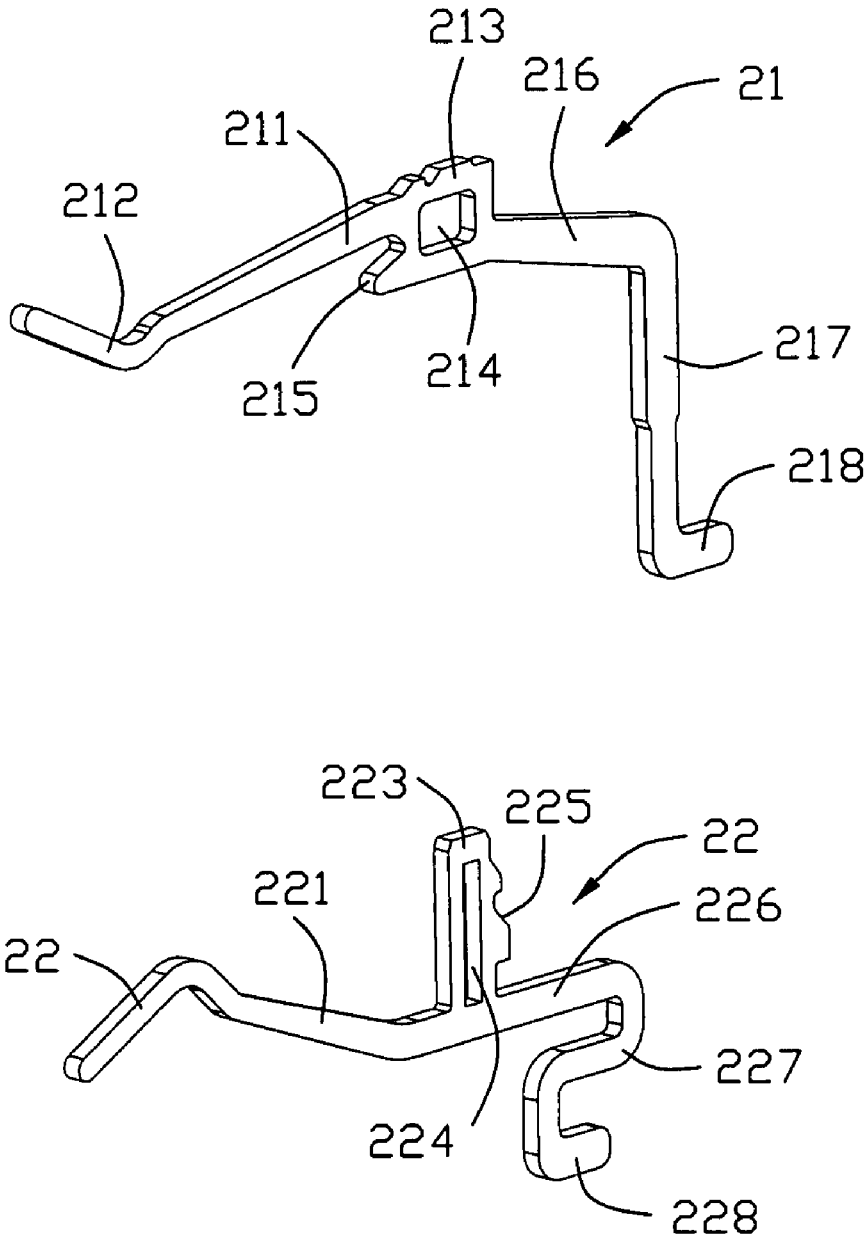
FIG. 3 is an enlarged view of a pair of terminals of the electrical connector.
Figure 4:
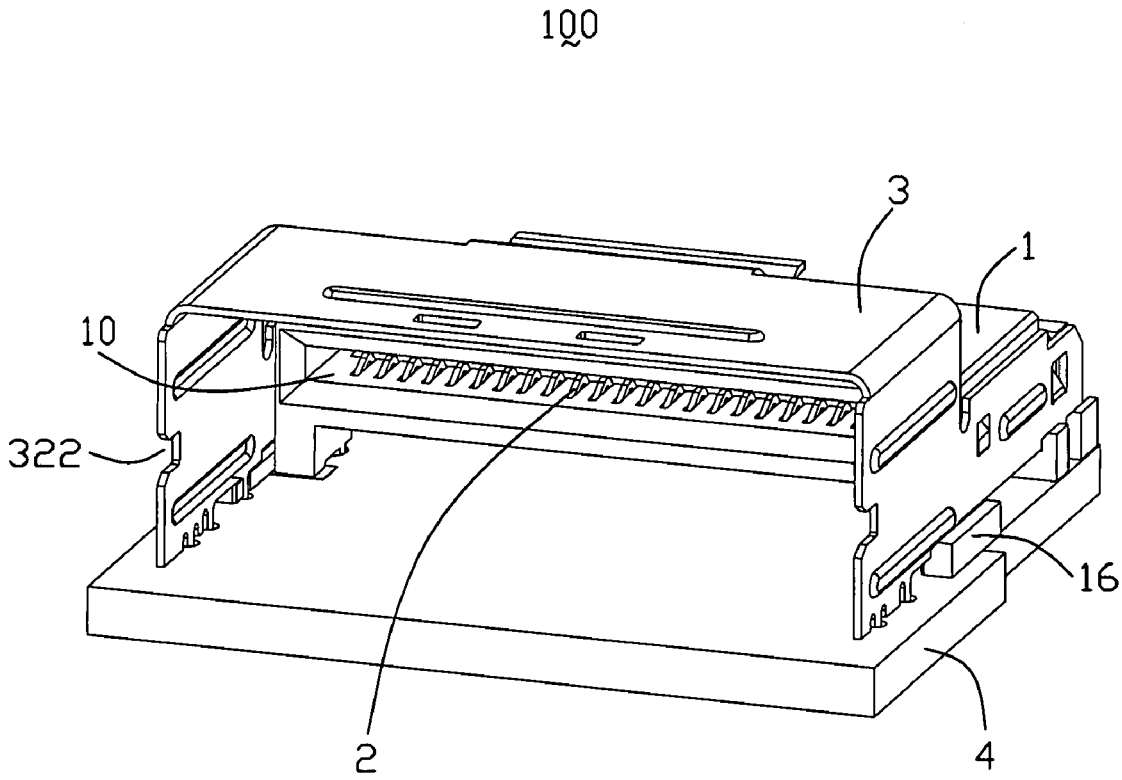
FIG. 4 is an assembled, perspective view of the electrical connector.
Figure 5:
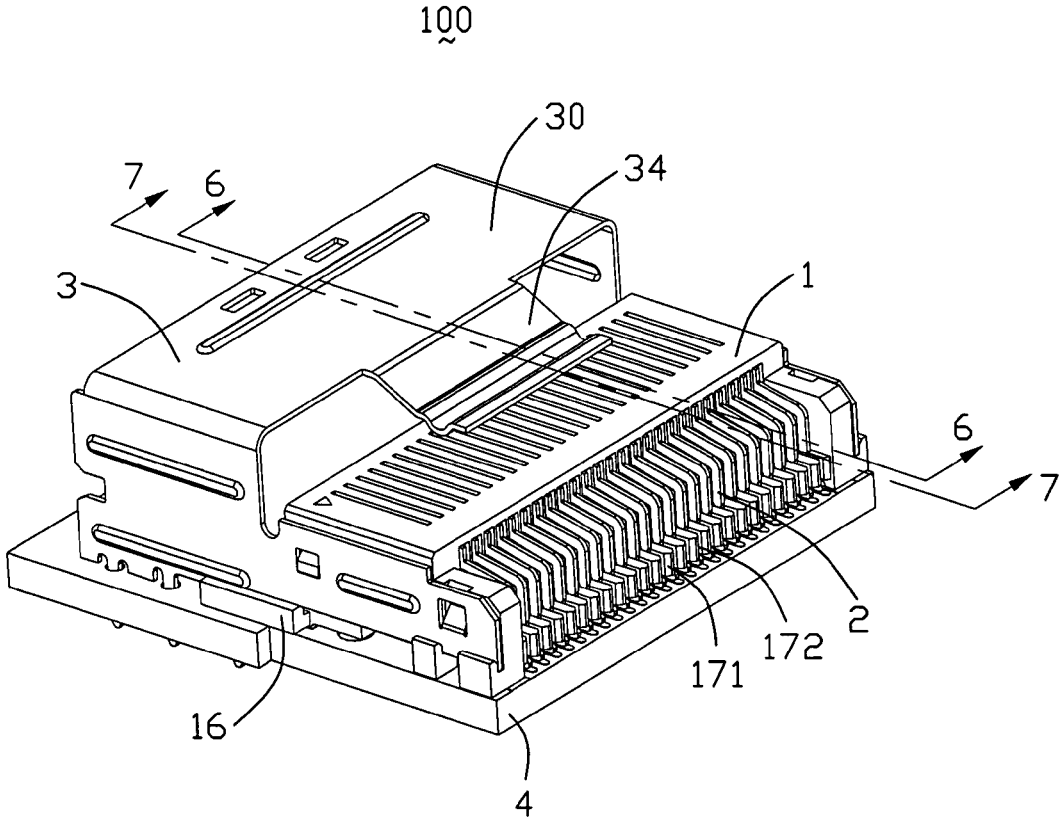
FIG. 5 is an assembled, perspective view of the electrical connector similar to FIG. 4, but viewed from different aspect.
Figure 6:
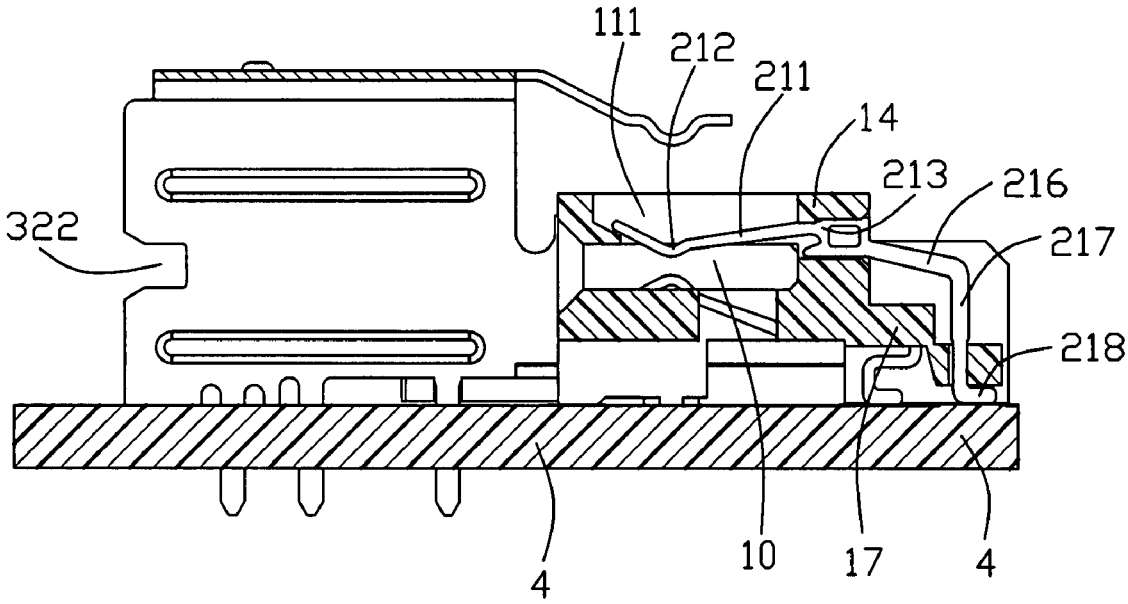
FIG. 6 is a cross-section view taken along line 6-6 of FIG. 5.
Figure 7:
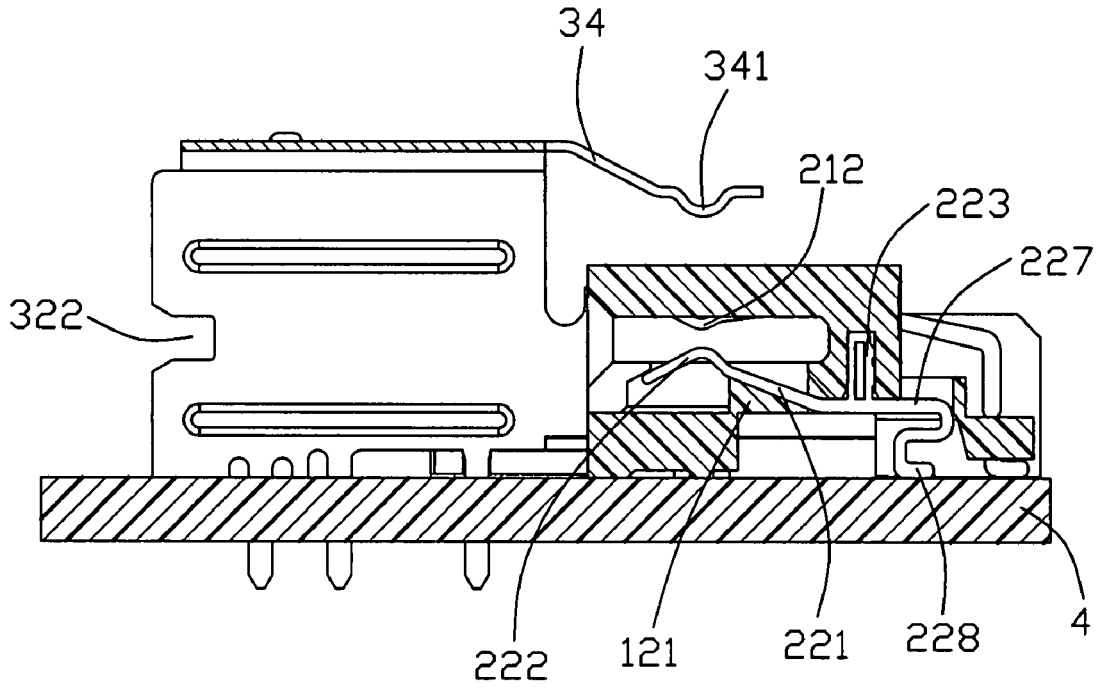
FIG. 7 is a cross-section view taken along line 7-7 of FIG. 5.

Referring to FIGS. 1-3, an electrical connector 100 for mounting on a circuit substrate 4 in accordance with the present invention comprises an insulated housing 1, a plurality of terminals 2 received in the insulated housing 1, and a metal shell 3 combined with the insulated housing 1.

The insulated housing 1 has a primary body portion 1*a* comprising a top wall 11, a bottom wall 12, a rear wall 14 and a pair of side walls 13 interconnecting with the top wall 11, the bottom wall 12 and the rear wall 14 to cooperatively enclose a hollow portion 10. The hollow portion 10 has an enlarged front opening 10*a* extending interiorly along a mating direction. Both the top wall 11 and the bottom wall 12 define a number of terminal slots 111, 121 interiorly recessed from an upper surface of the top wall 11 and a lower surface of the bottom wall 12 to communicate with the hollow portion 10. The terminal slots 111, 121 are arranged in two rows along transversal direction and offset from each other. The pair of side walls 13 respectively form a locking member 131 located on forward and middle outer surface thereof. Two supporting members 15 respectively align with the pair of side walls 13 and extend downward from lateral sides of a bottom of the bottom wall 12. Thus, the bottom wall 12 and the two supporting members 15 consist of a passage way 150 along mating direction. A rear section of each supporting members 15 is cut to form a gateway 151. Two positioning posts 152 are respectively adjacent to the gateways 151 and extend downward from bottom surfaces of two supporting member 15. A pair of lengthwise enforcing beams 16 are attached to two opposite outer surfaces (not numbered) of lower sections of the supporting members 15 and extend beyond a front face (not numbered) of the primary body portion 1*a*. Each of the enforcing beams 16 is configured to L-shaped cross-section and includes an outward vertical portion 161 and an inward horizontal portion 162 connecting with the vertical portion 161. The horizontal portion 162 defines a passage 163 along longitudinal direction (the mating direction) and a small cutout 164 located thereon proximate to a forward end thereof and extending along vertical direction.

The insulated housing 1 further has a secondary body portion 1*b* connecting to a back face of the primary body portion 1*a*. The secondary body portion 1*b* includes a pair of protection walls 18 respectively extending rearward from back edges (not numbered) of the pair of the side wall 13 of the primary body portion 1*a* and step-shaped platform portion 17 disposed between the protection walls 18 and extending rearward from lower section of the back face of the primary body portion 1*a*. Each protection wall 18 forms a first bulge 181 and a second bulge 182 apart from each other and laterally extend outward from a lower surface thereof. Therefore, a first groove 1811 and a second groove 1822 are formed between the first bulge 181, the second bulge 182 and the protection wall 18, respectively. The first groove 1811, the second groove 1822 and the passage 163 align with one another along longitudinal direction (mating direction). Each protection wall 18 further defines a vertical depression portion 183 on the outer surface thereof. The depression portion 183 substantially disposed between the first bulge 181 and the second bulge 182. A lower portion 171 of the platform portion 17 defines a number of gaps 172 arranged in a row along transversal direction.

Referring to FIG. 3, the terminals 2 comprise a plurality of first set of terminals 21 and second set of terminals 22 arranged in two distinct rows along vertical direction. Either of the first set of terminals 21 or the second set of terminals 22 is aligned in a row along transversal direction. Each of the first set of terminals 21 includes a forward and downward slant contact beam 211 with a curved contact portion 212 formed at a forward end thereof, an expanded retention portion 213 formed at a back end of the contact beam 211, a transition portion 216 slightly inclined extending rearward and downward from a lower section of an end edge of the retention portion 213 and a vertical leg portion 217 downward extending from an end of the transition portion 216 and a foot portion 218 bent rearward at angle about ninety degree to the vertical leg portion 217. The retention portion 213 of each of the first set of terminals 21 further has a rectangular-shaped adjusting hole 214 therein and a tapered protrusion portion 215 formed at lower edge of a forward end of the retention portion 213 and spaced apart from the contact beam 211 at a certain angle.

Each of the second set of terminals 22 includes a forward and upwardly slant contact beam 221 with a curved contact portion 222, a horizontal transition portion 226 extending rearward from an end portion of the contact beam 221, an upright retention portion 223 formed at middle section of the transition portion 226, an inverted zigzag-shaped supporting portion 227 with its top end portion engaging with an end portion of the transition portion 226. The inverted zigzag-shaped supporting portion 227 has a horizontal foot portion 228 stretching backward therefrom. The retention portion 223 is substantially rectangular-shaped with a vertical slot 224 therein and barbs 225 formed on a lateral side thereof. A configuration of the zigzag-shaped supporting portion 227 can control impedance of the terminal 22 and further improve electrical performance of signal transmission.

The metal shell 3 comprises an upper wall 31 and a pair of transversal walls 32 connecting with the upper wall 31 to form a substantially an inverted U-shape body portion 30. The inverted U-shape body portion 30 defines a roomage 36 adapted for leading the insertion of a complementary connector (not shown). A pair of stretching arms 33 respectively extend rearward from lower sections of back edges of the transversal walls 32, and a spring member 34 slantways extending downward and rearward from middle part of rear edge of the upper wall 31 with a curved capturing portion 341 formed at lower section of the spring member 34. The spring member 34 via capturing portion 341 thereof exerts a downward force onto a mating portion of the complementary connector to prevent the mating portion rotating upward, thus the complementary connector can mate with the electrical connector more accurately. The pair of stretching arms 33 define a space 35 therebetween and the distance between the arms 33 is substantially equal to a transversal dimension of the insulated housing 1. A pair of locking apertures 311 for latching with latching portions of the complementary connector are defined on the upper wall 31. A pair of rectangular-shaped cutouts 322 with front outlet is defined on the front parts of and the transversal walls 32. The cutout 322 together with hollow portion 10 of the insulated housing 1 substantially lies on a horizontal geometrical plane. The cutouts 322 are adapted to offer an aligning means which insures the electrical connector engaging the complementary connector reliably. A first through hole 331 and a second through hole 332 are defined in the front part and the relative rear part of each of the pair of stretching arms 33, respectively. A spring tab 333 extends from lower edge of the second through hole 332 and further extend into the space 35. Three pairs of board locks 321 respectively extend downwardly from the bottom edge of the transversal walls 32. The board locks 321 can also serve for grounding paths.

The circuit substrate 4 has a plurality of conductive traces arranged in distinct first set of conductive traces 41 and second set of conductive traces 42. A pair of positioning holes 44 located at lateral sections nearby the second set of conductive traces 42 of the circuit substrate 4. Three pairs of circular holes 43 are spaced arranged before the positioning holes 44 of the circuit substrate 4.

Referring to FIGS. 4-7 in conjunction with FIGS. 1-3, when assembly, firstly, the first set of terminals 21 are assembled to the top wall 11 of the insulated housing 1 along a front-to-back (horizontal) direction, with the contact beams 211 disposed in the terminal slots 111, the contact portions 212 extending into the hollow portion 10, the retention portions 213 interferentially retained in an upper section of the rear wall 14, the transition portions 216 located above the platform portion 17, and lower sections of the leg portions 217 sandwiched in the gaps 172 of the platform portion 17. Secondly, the second set of terminals 22 are assembled to the bottom wall 12 of the insulated housing 1 along a vertical direction perpendicular to the front-to-back direction, with the contact beams 221 disposed in the terminal slots 121, the contact portions 222 extending into the hollow portion 10, the retention portions 223 inserted into a lower section of the rear wall 14, and zigzag-shaped supporting portion 227 exposed outside of a bottom surface of the platform portion 17.

Thirdly, the metal shell 3 is assembled to the insulated housing 1, with the insulated housing 1 accommodated in the space 35 formed between the pair of stretching arms 33, the pair of board locks 321 adjacent to the pair of stretching arms 33 inserting through the pair of cutouts 164 of the enforcing beam 16 and retained therein, lower edges of front sections of the pair of arms 33 and rear sections of the pair of the transversal walls 32 sandwiched by the passages 163 of the enforcing beam 16, lower edges of rear sections of the pair of arms 33 sandwiched by the first grooves 1811 and the second grooves 1822, the locking members 131 locked into the first through holes 331 of the arms 33 and the spring tabs 333 received in the depression portions 183 of the protection walls 18. Thus, the body portion 30 of the metal shell 3 is located forward of the front face of the insulated housing 1 and the spring member 34 of the metal shell 3 disposed above the top wall 11 of the insulated housing 1, with the capturing portion 341 of the spring member 34 aligning with the contact portions 212, 222 of the first set and the second set of terminals 21, 22 along vertical direction. Fourthly, the insulated housing 1 and the metal shell 3 are together assembled to the circuit substrate 4, with the foot portions 218, 228 of the first set of and the second set of terminals 21, 22 respectively disposed on the conductive traces 41, 42, the positioning posts 152 received in the corresponding positioning holes 44 and the board locks 321 inserted into the corresponding circular holes 43 for retaining the electrical connector 100 to the circuit substrate 4. Fifthly, the foot portions 218, 228 are soldered to the conductive traces 41, 42 by surface mount technology (SMT) manner. The gateways 151 of the side walls 13 of the insulated housing 1 facilitate the air flow in soldering process to improve the quality of solder. In the present invention, the enforcing beams 16 can increase tolerance of the stretching arms 33 of the metal shell 3, and further enhance combination between the metal shell 3 and the insulate housing 1.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

What is claimed is:

1. An electrical connector adapted for mounting to a circuit substrate, comprising:

an insulated housing having a primary body portion including a top wall, a bottom wall and a pair of side walls interconnecting with the top wall and the bottom wall to cooperatively form a hollow portion;

a plurality of terminals received in the insulated housing;

a metal shell including an upper wall and a pair of transversal walls extending downwardly from two opposite side edges of the upper wall to form a substantially inverted U-shaped body portion, said metal shell further having a pair of arms extending rearward from rear edges of the transversal walls respectively and a spring member slantways extending downward and rearward from rear edge of the upper wall; and wherein the insulated housing further has a pair of enforcing beams attached to the lower sections thereof and extending beyond a front face of the insulated housing;

wherein the insulated housing is assembled between the arms of the metal shell, with the body portion of the metal shell located forwardly of the insulated housing and the spring member of the metal shell located above of the insulated housing; and wherein each of the pair of enforcing beams defines a passage along a mating direction sandwiching lower sections of the corresponding arm and the transversal wall of the metal shell.

2. The electrical connector as claimed in claim 1, wherein the insulated housing further has two supporting members respectively aligning with the pair of side walls and extend downwardly from lateral sides of a bottom of the bottom wall, wherein the bottom wall and the two supporting member consist of passage way along a mating direction.

3. The electrical connector as claimed in claim 2, wherein the pair of enforcing beams are formed on two opposite outer surfaces of lower sections of the supporting members and forwardly extend beyond the front face of the insulated housing.

4. The electrical connector as claimed in claim 1, wherein each of the enforcing beam is configured to L-shaped cross-section and including an outward vertical portion and an inward horizontal portion connecting with the vertical portion, and wherein the horizontal portion defines the passage along longitudinal direction.

5. The electrical connector as claimed in claim 1, wherein the insulated housing further comprises a secondary body portion connecting to a back face of the primary body portion of the insulated housing.

6. The electrical connector as claimed in claim 5, wherein the secondary body portion includes a pair of protection walls respectively extending rearward from back edges of the pair of the side walls of the primary body portion and step-shaped platform portion disposed between the protection walls and extending rearward from lower section of the back face of the primary body portion.

7. The electrical connector as claimed in claim 6, wherein each of the protection wall forms at least one bulge extending outward from a lower surface thereof, and wherein the bulge and the side wall form a groove therebetween.

8. The electrical connector as claimed in claim 7, wherein the groove aligns with the passage of the enforcing beam along the mating direction.

9. The electrical connector as claimed in claim 7, wherein each of the protection walls of the secondary body defines a vertical depression portion receiving a spring tab of the arm of the metal shell, and wherein each of the side walls of the primary forms a locking member locked into a through hole of the arm of the metal shell.

10. The electrical connector as claimed in claim 1, wherein the terminals are separated into a first set of terminals and a second set of terminals, wherein the first set of terminals and the second set of terminals are assembled to the insulated housing along different directions which are perpendicular to each other.

11. The electrical connector as claimed in claim 10, wherein the first set of terminals are assembled to the insulated housing along a horizontal direction and the second set of terminals are assembled to the insulated housing along a vertical direction.

12. The electrical connector as claimed in claim 10, wherein each of the first set of terminals comprises a contact beam with a curved contact portion, a retention portion formed at a back end of the contact beam, a transition portion extending rearward from an end edge of the retention portion and a vertical leg portion downward extending from an end of the transition portion, wherein the contact beam is received in corresponding terminal slot of the top wall, with the curved contact portion extending into the hollow portion, and wherein the transition portion and the vertical leg portion are disposed exteriorly of insulated housing.

13. The electrical connector as claimed in claim 10, wherein each of the second set of terminals comprises a contact beam with a curved contact portion, a horizontal transition portion extending rearward from an end portion of the contact beam, an upright retention portion formed at middle section of the transition portion, an inverted zigzag-shaped supporting portion with its top end portion engaging with an end portion of the transition portion, wherein the contact beam is received in corresponding terminal slot of the bottom wall, with the curved contact portion extending into the hollow portion, and wherein the inverted zigzag-shaped supporting portion is located beneath the insulated housing.

14. An electrical connector located on a circuit substrate, comprising:

an insulated housing having a primary body portion including a top wall, a bottom wall and a pair of side walls interconnecting with the top wall and the bottom wall to cooperatively form a hollow portion;

a plurality of terminals received in the insulated housing;

a metal shell having an upper wall and a pair of transversal walls extending downwardly from the upper wall to form a substantially inverted U-shaped body portion, said each transversal wall defining a cutout with a front outlet;

wherein the metal shell further including a pair of arms extending rearward from rear edges of the transversal walls; and wherein the insulated housing further has a pair of enforcing beams coupled to two opposite lower sections thereof;

wherein the insulated housing is assembled between the pair of arms of the metal shell, with the cutouts of the transversal walls of the metal shell and the hollow portion of the insulated housing substantially lie on a horizontal geometrical plane;

wherein each of the pair of enforcing beams defines a passage along a mating direction to sandwich lower sections of the corresponding arm and the transversal wall of the metal shell.

15. The electrical connector as claimed in claim 14, wherein each of the enforcing beam defines a cutout proximate to a forward end thereof, and wherein each of the transversal wall has a board lock extending downward from bottom edge thereof and passing the cutout.

16. The electrical connector as claimed in claim 14, wherein the metal shell further comprises a spring member slantways extending downward and rearward from rear edge of the upper wall, and wherein the spring forms a curved capturing portion at end portion thereof.

17. The electrical connector as claimed in claim 16, wherein the terminals are arranged into distinct rows and received in the terminal slots of the insulated housing and each terminal has a contact portion extending into hollow portion of the insulated housing, and wherein the capturing portion of the spring member of the metal shell aligns with the contact portions of the terminals along vertical direction.

18. An electrical connector assembly comprising:

a printed circuit board;

an electrical connector including:

an insulative housing self-mounted to the printed circuit board and defining a front mating face; and a metallic shell having essentially an upside-down U-shaped configuration and self-mounted to the printed circuit board essentially in front of the housing under a condition that the front mating face is essentially behind a rear face of the said U-shaped configuration; wherein the housing further includes a pair of reinforcing beams forwardly extending beyond said front mating face to be engaged with two side walls of said shell.

19. The electrical connector assembly as claimed in claim 18, wherein the shell further includes a pair of arms extending rearward beyond the front mating face to be engaged with two side walls of the housing.

20. The electrical connector assembly as claimed in claim 19, wherein the pair of arms is longer than the U-shaped configuration in a mating direction of the connector.

* * * * *